US005268030A

United States Patent [19]

Floyd et al.

[11] Patent Number: 5,268,030

[45] Date of Patent: Dec. 7, 1993

[54] PAPER COATING COMPOSITION CONTAINING A ZIRCONIUM CHELATE INSOLUBILIZER

[75] Inventors: William C. Floyd, Chester, S.C.; Sharif Sharif, Midland, Tex.

[73] Assignee: Sequa Chemicals Inc., Chester, S.C.

[21] Appl. No.: 856,361

[22] Filed: Mar. 23, 1992

[51] Int. Cl.[5] ..... C08K 3/00; C08K 5/00

[52] U.S. Cl. ..... 106/450; 106/505

[58] Field of Search ..... 106/505, 450

[56] References Cited

U.S. PATENT DOCUMENTS

| | | | |
|---|---|---|---|
| 2,498,514 | 2/1950 | VanMater | 167/90 |
| 2,780,555 | 2/1957 | Budewitz | 106/208 |
| 3,332,794 | 7/1967 | Hart | 106/194 |
| 3,741,782 | 6/1973 | Stewart et al. | 106/162 |
| 3,936,404 | 2/1976 | Ishizuka et al. | 260/29.2 N |
| 3,956,226 | 5/1976 | Blumenthal | 260/37 EP |
| 3,961,026 | 6/1976 | Pokhodenko et al. | 423/419 |
| 3,966,502 | 6/1976 | Binns | 148/6 |
| 4,007,146 | 2/1977 | Ishizuka et al. | 260/29.2 E |
| 4,008,195 | 2/1977 | Ishizuka et al. | 260/29.2 N |
| 4,061,720 | 12/1977 | Phillips | 423/265 |

OTHER PUBLICATIONS

I. McAlpine, "Ammonium Zirconium Carbonate, An Alternative Insolubilizer For Coating Binders", 1982 TAPPI of the Technical Association of the Pulp and Paper Industry (Coatings Conference issue).

*Primary Examiner*—Mark L. Bell
*Assistant Examiner*—Margaret Einsmann

[57] ABSTRACT

A paper coating composition is prepared containing a pigment, a binder and as an insolubilizer for the binder a zirconium chelate containing an alpha-hydroxy carboxylic acid ligand.

16 Claims, No Drawings

PAPER COATING COMPOSITION CONTAINING A ZIRCONIUM CHELATE INSOLUBILIZER

BACKGROUND

It is known that zirconium salts such as the oxychloride, acetate and ammonium zirconyl carbonate (AZC) are able to convert aqueous solutions of polymers capable of forming hydrophilic colloids, whether naturally occurring polymers such as starch and casein or synthetic polymers such as polyacrylic acid, polyvinyl acetate, polyvinyl alcohol or cellulose derivatives, into insoluble films. These films exhibit excellent adhesive qualities and water resistance and find applications in many technologies particularly those technologies concerned with the manufacture and use of paper and paper board.

Although those salts of zirconium which give aqueous solutions of pH less than 7, e.g. the oxychloride and acetate, are highly effective as insolublizing agents the practical application of their insolublizing property is often limited by their corrosive nature, the uncontrolled speed of their gelling action and by the fact that many practical systems, e.g. most of those in paper coating technology, operate at a pH greater than 7. An illustration of their application is provided by the use of zirconium acetate solution as a wash liquid which is applied to a coating of starch on paper in order to render the starch coating insoluble. In addition with AZC, its solutions suffer reduced stability at neutral and lower pH due to decomposition of the carbonate ion. This instability of alkali metal zirconyl carbonate solutions inhibits their use in paper coating systems.

SUMMARY OF THE INVENTION

Briefly, a paper coating composition is provided comprising a pigment, a binder and as an insolubilizer for the binder a zirconium chelate containing an alpha-hydroxy carboxylic acid ligand. The preferred chelate is an ammonium zirconium chelate with a ligand of lactic acid, citric acid or mixtures thereof.

DETAILED DESCRIPTION OF THE INVENTION

In accordance with this invention zirconium chelates containing an alpha-hydroxy carboxylic acid ligand are utilized as an insolubilizer for binders in paper coating compositions.

Zirconium chelates insolubilizers, and mixtures thereof, have been found to behave differently from the zirconium salts, and to afford several advantages. The chelates can be formulated at acidic, neutral or alkaline pH whereas acidic zirconium salts precipitate as hydrous zirconia when the pH is raised. Alkaline zirconium salts such as the carbonate, decompose when the pH is lowered. The chelates are reported to possess three binding sites per zirconium atom whereas the salt AZC is reported to dimerize and have one binding site per zirconium atom. The chelation appears to stabilize the zirconium atom so that dimerization does not occur. This results in a different curing mechanism for the paper coating which provides greater efficiency. This greater efficiency has been demonstrated by obtaining equivalent wet rub performance using 3% chelate insolubilizer (as measured by $ZrO_2$) as compared to 8% AZC, on dry weight of the protein. AZC used at 3% was significantly inferior to 3% chelate insolubilizer. Unless otherwise specified, amounts of zirconium chemicals are expressed as $ZrO_2$ equivalents or $ZrO_2$ content, which may be determined by ashing.

A stable zirconium chelate solution is prepared utilizing solutions of zirconium such as zirconium oxychloride, zirconium hydroxychloride, zirconium acetate and the like, and ammonium, or ammonium derivatives such as methyl ammonium, dimethyl ammonium and hydroxyethyl ammonium, water soluble amines or amine derivatives such as triethanolamine and diisopropylamine or a mixture of two or more of these bases or an alkali metal hydroxide such as sodium or potassium hydroxide. Also an alpha-hydroxy carboxylic acid, preferably lactic, or citric acid or mixtures thereof are utilized.

The reaction to prepare the zirconium chelate involves the stoichiometric reaction between ammonium, sodium or potassium hydroxides or water soluble amines or amine derivatives with alpha-hydroxy carboxylic acid, such as lactic, citric or tartaric acid or mixtures thereof to prepare a neutral solution of the corresponding alpha-hydroxy carboxylic salt. The obtained alkali metal, ammonium or amine (or amine derviative) alpha-hydroxy carboxylic salt is then added to a solution of zirconium which may be zirconium oxychloride, zirconium hydroxy chloride, zirconium acetate or the like. This procedure produces a mildly acidic or basic solution of the corresponding zirconium alpha-hydroxy carboxylic chelate. Alternatively, the alpha-hydroxy carboxylic salt may be added in solid form to the zirconium starting material. In each situation, the last step of the process is the addition of the alpha-hydroxy carboxylic salt to the zirconium compound selected from the group consisting of zirconium hydroxychloride, zirconium oxychloride, zirconium oxynitrate, zirconium hydroxynitrate, ammonium zirconium carbonate, zirconium acetate, zirconium sulfate, zirconium oxybromide, zirconium hydroxybromide and mixtures thereof. A chloride based zirconium compound (containing ammonium chloride as a by-product) is preferred as it provides a lower viscosity in the paper coating over time in comparision with chelate solutions which contain no ammonium chloride by product.

The resultant zirconium chelate preferably has a pH within the range of 3 to 10, with an alpha-hydroxy carboxylic acid to zirconium molar ratio between 0.5 to 1.0 and 20 to 1.0 and wherein the zirconium content is from 0.5 to 17 percent by weight of the solution (as determined by zirconium dioxide equivalent).

It should be noted that this preferred systhesis process has a 100% chemical yield and does not generate either organic or inorganic effluent or solid waste. The process utilizes only aqueous chemicals to produce purely aqueous products which eliminate the need for organic solvents and the attendant fire hazards and other disadvantages.

In the past, the recommended procedure for solubilizing protein called for cooking out the protein in water in which the pH was adjusted to 9.0 to 9.5 with excess ammonia. This often resulted in an ammonia odor in the mill. The ammonia odor of AZC under such conditions was inconsequential. Recently, however, new, pre-neutralized proteins have become commercialized which readily disperse to form a protein solution having a pH between 6.0 and 7.0. These new products are much less odiferous, making the odor of AZC more noticeable. Further, the stability of AZC is questionable under these neutral pH conditions. The ammonia content of the zirconium chelate is more stoichiometrically controlled, resulting in less odor.

The preferred chelate insolubilizers are ammonium zirconium chelates which utilize lactic acid and/or citric acid ligands, preferably at a ratio of acid to zirconium of from 0.5:1 to 7:1. These insolubilizers have been found to have improved performance in the paper coating including coating viscosity, coating rheology, wet rub resistance, dry pick, SIWA, HST and other important properties of coated paper.

The binders used in the paper coating compositions of this invention include, but are not limited to, unmodified starch; oxidized starch; enzyme-converted starch; starches having functional groups such as hydroxyl, carboxyl, amido, and amino groups; proteins, such as soy protein or casein or synthetically modified proteins; latexes, such as styrenebutadiene resin; and the like, and their mixtures.

The pigments may be clay with or without titanium dioxide and/or calcium carbonate, and the like, and mixtures thereof.

In addition to the binder, the pigment material, and the insolubilizer described above, paper coating compositions may also include conventional materials such as lubricants, defoamers, preservatives, colored pigments, and the like, in conventional amounts.

In the paper coating compositions described herein, the amount of binder is based upon the amount of pigment; the ratio varies with the amount of bonding desired and with the adhesive characteristics of the particular binder employed. In general the amount of binder is about 10 to 25 percent, and preferably about 12 to 18 percent, based on the weight of the pigment.

The amount of insolubilizer varies with the amount and properties of the binder and the amount of insolubilization desired; in general, the ammonium zirconium chelate insolubilizer is utilized in the paper coating composition at a level of from 0.1 to 10%, preferably 1 to 5% (as measured by Zr02 equivalent) by dry weight of the binder.

The total solids content of the composition generally is within the range of about 40 to 70 percent, depending upon the method of application and the product requirements.

The compositions of this invention can be applied to paper or paper-like substrates by any known and convenient means.

In order that the present invention may be more fully understood, the following examples are given by way of illustration. No specific details contained therein should be construed as limitations on the present invention except insofar as they appear in the appended claims.

Example I (i) In 2000 ml glass beaker 818.9 gm of 88% lactic acid was weighed out. The beaker was placed on a magnetic stirrer and the lactic acid was agitated using a magnetic bar.

(ii) Gradually 485.7 gm of 28% ammonium hydroxide solution was added to prepare ammonium lactate. In this mixture the $NH_3$ to lactate molar ratio is 1.0 to 1.0, based on 88% acid and 28% $NH_3$ in the lactic acid and the ammonium hydroxide solution, respectively. This neutralization reaction is exothermic and the addition of the ammonium hydroxide solution must be slow enough to avoid any boil-over. The temperature of the produced ammonium lactate solution was between 150° F. and 200° F. (65° C. and 93° C.).

(iii) In a 4000 ml glass beaker 1000 gm of zirconium chloride hydroxide solution (20% $ZrO_2$), a chloride based zirconium compound, was weighed and mixing was started. Gradually, the above hot ammonium lactate solution was added to the zirconium chloride hydroxide solution while mixing. After all of the ammonium lactate solution was added, the solution was mixed for an additional 15 minutes. When the reaction batch was cooled to room temperature, its pH was between 5.0 and 7.0 at this stage of the preparation. The temperature of ammonium lactate solution before its addition to zirconium chloride hydroxide was found to have no effect on the quality of the product.

(iv) The produced intermediate was almost a neutral solution of ammonium zirconium lactate which assays 8.7% $Zr_2$ at a lactate to zirconium molar ratio of 5.0 to 1.0.

The obtained product was stable on boiling, aging, dilution and when its pH was altered (by the addition of HC1 or ammonium hydroxide) in the range of 3.0 to 10.0.

Example II (i) In a suitable beaker 315.2 gm of sodium citrate dihydrate was dissolved in 598.4 gm of distilled water and a clear solution was obtained. This solution of sodium citrate can also be obtained by mixing sodium hydroxide solution with citric acid solution or citric acid solids with sodium hydroxide solution or by mixing sodium hydroxide solids with citric acid solution.

(ii) The above sodium citrate solution was added to 500 gm of zirconium hydroxychloride solution which contains 20.0% $ZrO_2$. The reaction batch was mixed continuously while the sodium citrate was being added. A clear solution of sodium zirconium citrate was obtained after the addition of sodium citrate solution was completed. The pH of the solution product was 6.2.

(iii) 23 gm of 50% sodium hydroxide was added to raise the product pH to 9.0. The citrate to zirconium molar ratio in this product was 1.34 to 1.00. The product contained 7.0% $ZrO_2$ and was stable on boiling, aging and dilution to very low $ZrO_2$ concentrations.

The starting zirconium material in Examples 1 and 2 was zirconium hydroxychloride, however, any one or mixtures of the following zirconium chemicals may be used:

(i) zirconium oxychloride
(ii) zirconium oxynitrate
(iii) zirconium hydroxynitrate
(iv) ammonium zirconium carbonate
(v) zirconium acetate
(vi) zirconium oxybromide
(vii) zirconium hydroxybromide Also a mixture of zirconium hydroxychloride and any or all of the above zirconium starting materials can be used in the preparation of similar products.

Example III (i) 97.1 gm of 28% ammonium hydroxide solution was mixed with 163.8 gm of 88% lactic acid to prepare ammonium lactate solution.

(ii) The above ammonium lactate solution was added to 500 gm of zirconium hydroxychloride solution which contains 20% $ZrO_2$ while mixing. A clear solution with a pH of 4.3 was obtained.

(iii) 154 gm of 28% ammonium hydroxide solution was added to establish a pH of 9.0 in the final solution product. The $ZrO_2$ content in the product was 10.9%.

This ammonium zirconium lactate solution was stable on boiling, aging, dilution and the addition of bases and acids to alter the pH between 3.0 to 10. The lactate to zirconium molar ratio was 2.0 to 1.0.

Example IV 506.9 gm of 28% ammonium hydroxide solution was added to 409.5 gm of 88% lactic acid to prepare ammonium lactate solution.

The above ammonium lactate solution was added to 500 gm of zirconium hydroxynitrate solution which contained 20.0% $ZrO_2$. A clear and stable solution of ammonium zirconium lactate was obtained. The solution product had a pH of 5.3 and it contained 7.0% $ZrO_2$. The lactate to zirconium molar ratio in the product was 5.0 to 1.0

The product was stable on the addition of acids or bases, dilution, boiling, and/or aging.

Example V

A paper coating was prepared with the following formulation based on dry weights and 100 parts of pigment:

| | |
|---|---|
| Dow 620 (styrene-butadiene latex from Dow Chemicals Co.), | 11 parts |
| Procote 400 (soybean protein from Protein Technologies, Inc.) | 7 parts |
| 40% Sodium polyacrylate dispersant (Dispex N-40, Allied Colloids) | 0.2 parts |
| TSPP dispersant (tetrasodium pyrophosphate by Monsanto) | 0.2 parts |
| Insolubilizer | See Below |
| A) Stabilized AZC* | 8% as $ZrO_2$ on dry protein |
| B) Ammonium zirconium lactate (3:1 of lactate:zirconium) | 8% as $ZrO_2$ on dry protein |
| C) Cyclic amide/glyoxal condensate | 8% dry resin on dry solids |
| D) Blank | |

*AZC stabilized with tartaric acid (Bacote ® 20 from Magnesium Electron, Inc.)

The coating was formulated at pH of 9.5, with 54% solids and applied at a rate of four (4) pounds per 1000 sq. ft. with a trailing blade coater. The board was calendered at 175 F. at 400 psig. The following results were obtained.

| | A | B | C | D |
|---|---|---|---|---|
| Brookfield visc., of coating | | | | |
| @ 20 rpm | 3000 | 5650 | 5750 | 3650 |
| @ 100 rpm | 1020 | 1630 | 1590 | 1150 |
| Adam wet rub, 45 sec., mg coating removed | 4.6 | 4.1 | 6.3 | 5.3 |

This demonstrates that the ammonium zirconium chelate is effective in insolubilizing protein showing improved wet rub performance.

Example VI

A coating similar to that used in Example V was prepared and used with the following insolubilizers:

| | |
|---|---|
| A) Stabilized AZC | 8% as $ZrO_2$ on dry protein |
| B) Ammonium zirconium lactate (3:1) | 3% as $ZrO_2$ on dry protein |
| C) Stabilized AZC | 3% as $ZrO_2$ on dry protein |
| D) Blank | |

The paper was coated and calendered in the same manner with the following results:

| | A | B | C | D |
|---|---|---|---|---|
| Brookfield visc., cps | | | | |
| @ 20 rpm | 4250 | 8250 | 4750 | 6250 |
| @ 100 rpm | 1650 | 2750 | 1700 | 2100 |
| Adam wet rub, 10 sec. mg | 1.4 | 1.0 | 3.5 | 8.1 |
| Printed Ink gloss | 63.0 | 66.4 | 63.8 | 61.8 |
| Hercules size test, sec. | 11.5 | 15.1 | 9.1 | 10.1 |
| Sheet gloss | 52.2 | 53.6 | 50.6 | 51.9 |

These results demonstrate that the ammonium zirconium chelate at 3% is able to give equivalent performance to the AZC at 8%. The AZC at 3% is noticeably inferior.

Example VII

A coating similar to that used in Example 1 was prepared and used with the following insolubilizers:

| | |
|---|---|
| A) Stabilized AZC | 8% as $ZrO_2$ on dry protein |
| B) Ammonium zirconium lactate (3:1) | 3% as $ZrO_2$ on dry protein |
| C) Sodium zirconium aluminum citrate | 3% as $ZrO_2$ on dry protein |
| D) Blank | |

The following results were obtained:

| | | | | |
|---|---|---|---|---|
| Brookfield visc., cps | | | | |
| @ 20 rpm | 14750 | 19500 | 22750 | 13750 |
| @ 100 rpm | 4200 | 5250 | 6300 | 3950 |
| IGT dry pick | 49.4 | 53.6 | 53.6 | 53.6 |
| Ink gloss | 63.7 | 62.1 | 60.2 | 61.6 |
| Adams wet rub, mg | 3.9 | 1.8 | 17.9 | 4.9 |

These results show that the ammonium zirconium chelates provide superior dry pick as compared to AZC and also provides superior wet rub resistance. The sodium zirconium aluminum citrate does not contain a fugitive alkali as does the lactate, and does not develop adequate water resistance.

Example VIII

To understand the rheology of the papercoating color an experiment was done in which raw material source and pH were the variables. The coating mix was similar to that used in Example 1. The following insolubilizers were used:

| | |
|---|---|
| A) Stabilized AZC | 8% as $ZrO_2$ on dry protein |
| B) Sulfate based ammonium zirconium lactate, pH 7, 3:1 molar ratio (L:Zr) | 3% as $ZrO_2$ on dry protein |
| C) Chloride based ammonium zirconium lactate, pH 7, 3:1 molar ratio (L:Zr) | 3% as $ZrO_2$ on dry protein |
| D) Chloride based ammonium zirconium lactate, pH 7, 2:1 molar ratio (L:Zr) | 3% as $ZrO_2$ on dry protein |
| E) Chloride based ammonium zirconium lactate, pH 4.3 2:1 molar ratio (L:Zr) | 3% as $ZrO_2$ on dry protein |
| F) Blank | |

-continued

| | A | B | C | D | E | F |
|---|---|---|---|---|---|---|
| Initial, cps | | | | | | |
| @ 20 rpm | 12250 | 15750 | 13750 | 14750 | 15500 | 12750 |
| @ 100 rpm | 3600 | 4700 | 4200 | 4950 | 4750 | 3850 |
| 4 Hours | | | | | | |
| @ 20 rpm | 13750 | 19500 | 14500 | 15000 | 16500 | 15000 |
| @100 rpm | 4250 | 5400 | 4600 | 4400 | 4750 | 4350 |
| 24 Hours | | | | | | |
| @ 20 rpm | 16500 | 25000 | 17000 | 16000 | 17250 | 16000 |
| @ 100 rpm | 4450 | 6500 | 5000 | 4800 | 5500 | 4850 |

These results show that the presence of residual sulfate ion contributes to the coating viscosity increase. A chloride-based starting material (e.g. zirconium hydroxy chloride) is preferred in that the viscosity remains lower over time. A 2:1 lactate: zirconium ratio gives similar performance to the 3:1 product. The 2:1 product at pH 7 gives a lower viscosity increase than the 2:1 product at pH 4.3.

Example IX

To further understand factors affecting coating color rheology, a series of samples containing different additives was examined. These additives could either be introduced by the particular raw material stream, or by post-addition to the ammonium zirconium/lactate solution. A coating color similar to that used in Example 1, but formulated at 48% solids for use on an air knife coater was employed. The stabilized AZC was used at the level of 8% $ZrO_2$ equivalent on dry protein. The ammonium zirconium lactate (5:1 lactate: zirconium) chelates were used at 3% $ZrO_2$ on dry protein. The insolubilizers used were as follows:

A) Stabilized AZC
B) Chloride-based ammonium zirconium lactate (AZL)
C) Sulfate-based AZL
D) Nitrate-based AZL
E) Chloride-based AZL with 3.5% urea
F) Chloride-based AZL with 3.5% ammonium carbonate
G) Chloride-based AZL with 3.5% sodium bicarbonate
H) Chloride-based AZL with 3.5% sodium carbonate
I) Blank

| | The following coating viscosities were observed: | | | | | | | | |
|---|---|---|---|---|---|---|---|---|---|
| | A | B | C | D | E | F | G | H | I |
| Initial, cps | | | | | | | | | |
| @ 20 rpm | 1120 | 1760 | 1600 | 1780 | 1540 | 1140 | 1200 | 1320 | 1400 |
| @ 100 rpm | 428 | 976 | 1196 | 904 | 544 | 900 | 468 | 500 | 544 |
| 2 Hours | | | | | | | | | |
| @ 20 rpm | 1200 | 3200 | 3740 | 3960 | 3000 | 2140 | 2280 | 2300 | 1700 |
| @ 100 rpm | 496 | 1096 | 1484 | 1420 | 1060 | 780 | 820 | 824 | 620 |
| 4 Hours | | | | | | | | | |
| @ 20 rpm | 1300 | 3680 | 4400 | 4500 | 3400 | 2680 | 4400 | 4500 | 3400 |
| @ 100 rpm | 1048 | 1500 | 1580 | 1440 | 1160 | 876 | 904 | 940 | 1060 |
| 24 Hours | | | | | | | | | |
| @ 20 rpm | 1560 | 3940 | 5180 | 4840 | 4200 | 3480 | 3720 | 3540 | 2680 |
| @ 100 rpm | 620 | 1390 | 1508 | 1632 | 1420 | 1212 | 1252 | 1236 | 980 |

These results show that chloride-based raw materials afford products which produce lower coating viscosity than sulfate or nitrate based raw materials. Urea, was shown as effective in lowering viscosity. The addition of carbonate or bicarbonate ion appears to be even more effective in lowering coating viscosity. The use of ammonium carbonate appears to be particularly effective.

It was found that the coating formulation could be varied to exaggerate the differences in wet rub resistance and viscosity. To this end, Formula II was developed to examine wet rub resistance after being coated onto paper. Formula III was developed to examine viscosity response and rheology of the coating system over time. Formula IV was developed to examine viscosity and rheology in the presence of titanium dioxide. These formulae are shown below.

| | |
|---|---|
| Formula II | |
| #1 Clay | 100 parts |
| Dispex N-40 (Sodium polyacrylate dispersant, Allied Colloid) | 0.15 parts |
| Procote 400 | 7.0 parts |
| Water | As required for 56% solids, pH 9.0 |
| Formula III | |
| #1 Clay | 100 parts |
| Dispex N-40 | 0.25 parts |
| Procote 400 | 5.0 parts |
| Dow 620 | 4.0 parts |
| Water | As required for 54% solids, pH 9.0 |
| Formula IV | |
| #1 Clay | 90 parts |
| $TiO_2$ | 10 parts |
| N-40 | 0.25 parts |
| Procote 400 | 5.0 parts |
| Dow 620 | 4.0 parts |
| Water | as required for 35% solids, pH 9.0 |

Example X

Using Formula III, a 3:1 lactic acid: zirconium chelate (AZL) was evaluated alone, with a 0.67:1 citric acid: zirconium chelate, and with the addition of urea or ammonium carbonate. These zirconium chelates were added at the level of 3% $ZrO_2$ based on protein. For controls, a blank with no insolubilizer and a standard with 8% stabilized ammonium zirconium carbonate (as $ZrO_2$) were used. Brookfield viscosities at initial make up, one hour, 2 hours and 24 hours were recorded at 20 rpm and 100 rpm.

| | Brookfield Viscosity, cps | | | | | | | |
|---|---|---|---|---|---|---|---|---|
| | Initial | | 1 Hour | | 2 Hours | | 24 Hours | |
| | 20 rpm | 100 rpm | 20 rpm | 100 rpm | 20 rpm | 100 rpm | 20 rpm | 100 rpm |
| Control | 4600 | 1406 | 5200 | 1612 | 5080 | 1572 | 4980 | 1540 |
| AZC | 4380 | 1376 | 5800 | 1760 | 5480 | 1716 | 6900 | 2040 |
| 3:1 AZL | 6120 | 1820 | 7100 | 2072 | 7200 | 2116 | 7420 | 2248 |

-continued

| | Brookfield Viscosity, cps | | | | | | | |
|---|---|---|---|---|---|---|---|---|
| | Initial | | 1 Hour | | 2 Hours | | 24 Hours | |
| | 20 rpm | 100 rpm | 20 rpm | 100 rpm | 20 rpm | 100 rpm | 20 rpm | 100 rpm |
| 3:1 AZL/ 0.67:1 AZ citrate | 4160 | 1340 | 5000 | 1572 | 5000 | 1560 | 5480 | 1670 |
| AZ citrate | 3600 | 1232 | 4700 | 1480 | 4640 | 1508 | 5111 | 1640 |
| 3:1 AZL/ ammonium carbonate | 4800 | 1536 | 6000 | 1852 | 6320 | 1960 | 6520 | 2000 |
| AZL/ ammonium carbonate/ urea | 4680 | 1528 | 5860 | 1860 | 6000 | 1924 | 6420 | 2064 |

These results show that while the 3:1 AZL has a higher viscosity than the control and the ammonium zirconium carbonate, the viscosity can be greatly reduced by blending the AZL with ammonium zirconium citrate, ammonium carbonate, or urea.

Example XI

Using Formula II, a series of blends of 3:1 AZL and 0.67:1 AZ citrate were examined and compared to a blank and ammonium zirconium carbonate as controls. The ammonium zirconium carbonate was used at 8% $ZrO_2$ on weight of the protein while the zirconium chelate blends were used at 3% $ZrO_2$ on weight of the protein. The samples were coded as follows:

| | | |
|---|---|---|
| A) | Blank | |
| B) | Ammonium Zirconium Carbonate | |
| C) | AZL:AZ Citrate | .25:.75 |
| D) | AZL:AZ Citrate | .35:.65 |
| E) | AZL:AZ Citrate | .50:.50 |
| F) | AZL:AZ Citrate | .65:.35 |
| G) | AZL:AZ Citrate | .75:.25 |

-continued

| | |
|---|---|
| H) AZL:AZ Citrate:Urea | .50:.50:3.00% |

The coatings were applied with a blade coater, dried and subjected to a standard battery of tests. The test results are as follows:

| Sample | A | B | C | D | E | F | G | H |
|---|---|---|---|---|---|---|---|---|
| Brookfield, | | | | | | | | |
| 20 rpm | 8600 | 8750 | 8000 | 8900 | 8850 | 8400 | 9350 | 6750 |
| 100 rpm | 2920 | 2960 | 2740 | 2960 | 2870 | 2850 | 3170 | 2430 |
| Hercules Hi Shear | 38.3 | 39.1 | 38.2 | 39.9 | 41.2 | 39.2 | 41.2 | 39.8 |
| Coat wt./ 3000 sq. ft. | 8.5 | 8.1 | 8.2 | 8.2 | 8.2 | 8.5 | 8.5 | 8.4 |
| Adams wet rub, mg | 4.2 | 2.6 | 2.8 | 3.8 | 3.5 | 8.8 | 3.1 | 3.4 |
| Wet rub, % T | 88.3 | 95.6 | 94.8 | 95.5 | 96.1 | 89.2 | 95.5 | 94.5 |
| Sheet gloss, (75) | 60.1 | 57.6 | 57.5 | 61.9 | 59.3 | 59.7 | 57.1 | 57.8 |
| Printed Ink Gloss | 68.9 | 67.7 | 68.7 | 71.6 | 72.9 | 72.7 | 75.0 | 72.0 |
| Ink density | 2.11 | 2.11 | 2.12 | 2.17 | 2.18 | 2.17 | 2.20 | 2.21 |
| SIWA | 47.5 | 48.6 | 48.8 | 50.5 | 50.6 | 48.6 | 49.8 | 48.9 |
| Brightness | 80.9 | 80.5 | 80.9 | 80.5 | 81.5 | 80.5 | 80.9 | 80.9 |
| Croda | 61.1 | 62.0 | 62.4 | 75.2 | 80.4 | 79.4 | 79.7 | 81.0 |
| Dynamic Water Absorbance, mm | 130.5 | 128.5 | 122.5 | 131.5 | 133.5 | 135.0 | 130.0 | 132.5 |
| Dynamic Oil Absorbance, mm | 137.0 | 137.0 | 139.0 | 137.5 | 152.0 | 156.0 | 148.5 | 156.5 |

These results show that a roughly equal blend of the lactate and citrate zirconium chelates provide equal or better performance when used at 3% $ZrO_2$ on weight of the protein as compared to ammonium zirconium carbonate when used at 8% $ZrO_2$ on the weight of the protein. The blend offers optimum performance both in terms of coating rheology and coated paper properties.

Example XII

A study was done to compare the viscosity of the all clay pigment system of Formula III with the $TiO_2$-containing pigment system of Formula IV. For each formulation, a blank, an ammonium zirconium carbonate (8% on protein) and a 1:1 blend of AZL and AZ citrate were run.

| Viscosity, cps | Initial | | 1 Hour | | 2 Hours | | 4 Hours | |
|---|---|---|---|---|---|---|---|---|
| | 20 rpm | 100 rpm | 20 rpm | 100 rpm | 20 rpm | 100 rpm | 20 rpm | 100 rpm |
| Formula III | | | | | | | | |
| Blank | 5550 | 1850 | 5450 | 1870 | 6400 | 2030 | 6450 | 2080 |
| Am.Zr. Carbonate | 5300 | 1750 | 6350 | 2050 | 6450 | 1990 | 6950 | 2250 |
| AZL:AZ Cit. | 4350 | 1520 | 5350 | 1800 | 5450 | 1800 | 5350 | 1790 |
| Formula IV | | | | | | | | |
| Blank | 4700 | 1540 | 5100 | 1620 | 4950 | 600 | 4700 | 1550 |
| Am.Zr. Carbonate | 4600 | 1500 | 5350 | 1740 | 4950 | 1620 | 5100 | 1700 |

-continued

| Viscosity, | Initial | | 1 Hour | | 2 Hours | | 4 Hours | |
|---|---|---|---|---|---|---|---|---|
| cps | 20 rpm | 100 rpm | 20 rpm | 100 rpm | 20 rpm | 100 rpm | 20 rpm | 100 rpm |
| AZL:AZ Cit. | 4250 | 1450 | 4850 | 1590 | 4750 | 1620 | 4850 | 1600 |

These results show that the chelate blend gives a lower coating viscosity in both all-clay pigment systems and clay-$TiO_2$ pigment systems.

Example XIII

To a 3 liter beaker is added 245.7 gm of lactic acid and 208 gm of water. To this solution is added 206 gm of granular citric acid. This is stirred until dissolved. This mixture of acids is neutralized by addition of 210.8 gm of 28% ammonium hydroxide. This is added to 1000 gm of zirconium hydroxy chloride (20% as $ZrO_2$) with high agitation. The pH is then adjusted with 295 gm of 28% ammonium hydroxide to 9.0. The solids are cut to 7% $ZrO_2$ content by addition of 692.3 gm of water. The product obtained is a mixed lactate-citrate chelate of zirconium.

Example XIV

To a 10 liter reaction vessel is charged 3296 gm of water and 3296 gm of granular citric acid. This is neutralized with 1042 gm of 28% ammonium hydroxide. To a 30 liter reaction vessel is charged 8000 gm of zirconium hydroxy chloride solution (20% ZHC). To this is added with agitation, the above neutralized ammonium citrate solution The pH is raised to 9.2 with the addition of 3440gm of 28% ammonium hydroxide. The further addition of 3784gm of water reduces the solids to 7.05% $ZrO_2$. The product was a 1.34:1 (molar basis) citrate chelate of zirconium.

Example XV

A pilot coater trial was done using a commercial formulation similar to Formula IV. The insolublizers were AZC, a blocked glyoxal resin or the ammonium zirconium citrate-lactate blend of Example XIII. The zirconium insolubilizers were used at 3% wet on dry total binder. The wet AZC was 20% $ZrO_2$, the wet AZ chelate was 7% $ZrO_2$. The glyoxal resin was used at 5.2% dry on dry binder. Table I shows laboratory Brookfield viscosity at 20 and at 100 cps with and without crosslinker. Table II shows production coating viscosity at 20 and at 100 cps in the make up tank and the application pan along with the solids at each location. The coating was applied by an air knife coater. Coat weight on the machine varied from 4.0–5.2 pounds dry coating per 1000 sq. ft. The data in Table III shows the physical properties of the coated paper. These results show that the ammonium zirconium chelate products give performance equal to or better than currently used proten insolubilizers such as AZC or blocked glyoxal resins.

TABLE I

| Brookfield Viscosity 20/100 cpcs | No Crosslinker | | 4 Grams Wet Crosslinker | |
|---|---|---|---|---|
| | 20 cps | 100 cps | 20 cps | 100 cps |
| AZC | 1540 | 518 | 1255 | 475 |
| Glyoxal Resin | 1610 | 521 | 1420 | 495 |
| AZ Chelate | 1505 | 510 | 1195 | 436 |

TABLE II

| Production Coating Viscosity | AZC | Glyoxal Resin | AZ Chelate |
|---|---|---|---|
| Make-up Tank Viscosity 20/100 cps | | | |
| 5 min. mix time | 650/275 | 1325/440 | 550/230 |
| 2 hrs. mix time | 445/206 | | 420/190 |
| Make-up Tank Solids | 48.9% | 49.7% | 49.9% |
| Application Pan Visc. 20/100 cps | 385/193 | 475/218 | 395/184 |
| Application Pan Solids | 46.9% | 45.8% | 47.2% |

TABLE III

| Experimental High pH Insolubilizer Trial — Physical Property Data | AZC | Glyoxal Resin | AZ Chelate |
|---|---|---|---|
| Sheet Gloss 75 | 33.7 | 32.9 | 33.9 |
| Printed Ink Gloss 75 | 70.1 | 70.1 | 72.1 |
| Ink Density | 2.18 | 2.13 | 2.18 |
| Smoothness | 251 | 224 | 255 |
| Brightness | 80.2 | 78.3 | 79.5 |
| K & N, 2 minutes | 81.6 | 80.7 | 81.4 |
| Croda, 1 minute | 80.8 | 81.3 | 80.9 |
| SIWA | | | |
| Brightness | 68.5 | 67.8 | 68.8 |
| Ink Density Top | 2.35 | 2.37 | 2.38 |
| Dynamic Water, mm | 89.7 | 96.2 | 93.8 |
| IGT Dry Pick, | | | |
| MD, 4 m/s, MV Oil | 125.3 | 119.5 | 139.6 |
| CD, 3 m/s, MV Oil | 72.5 | 95.9 | 100.3 |
| Blister | 49.2 | 61.9 | 68.3 |
| Dry Crock, 5 cycles | Excellent | Excellent | Excellent |
| Adams Wet Rub, 10 sec. | | | |
| Off-machine, grams | 0.006 | 0.010 | 0.009 |
| % moisture | 7.0 | 8.0 | 8.1 |
| Humidity Room, grams | 0.0029 | 0.0031 | 0.0022 |
| % Moisture | 6.3 | 6.5 | 6.5 |

What is claimed is:

1. An aqueous paper coating composition comprising a pigment, a binder and as an insolubilizer for the binder a zirconium chelate containing an alpha-hydroxy carboxylic acid ligand.

2. The composition of claim 1 wherein the chelate is an ammonium zirconium chelate.

3. The composition of claim 2 wherein ammonium is an ammonium derivative selected from the group consisting of methyl ammonium, dimethyl ammonium and hydroxyethyl ammonium.

4. The composition of claim 2 wherein the ligand is chosen from the group consisting of lactic acid, citric acid or mixtures thereof.

5. The composition of claim 4 wherein the molar ratio of acid to zirconium is from 0.5:1 to 7:1.

6. The composition of claim 2 comprising 0.1 to 10% of ammonium zirconium chelate, as determined by $ZrO_2$ content, by dry weight of the binder.

7. The composition of claim 3 wherein the binder is chosen from the group consisting of starch, proteins and latex.

8. The composition of claim 2 wherein the method of preparing the zirconium chelate comprises reacting ammonium hydroxide or ammonium derivatives with an alpha-hydroxy carboxylic acid to prepare an almost neutral solution of the corresponding alpha-hydroxy carboxylic salt; and adding said alpha-hydroxy carboxylic salt to a solution of a zirconium compound to form a zirconium chelate.

9. The composition of claim 8 wherein stoichiometric quantities of the reactants are used to produce the zirconium chelate.

10. The composition of claim 8 wherein the zirconium chelate has a pH in the rang of 3 to 10.

11. The composition of claim 8 wherein the alpha-hydroxy carboxylic acid to zirconium molar ratio is between 0.5 to 1.0 and 20 to 1.0.

12. The composition of claim 11 wherein the zirconium content as determined by zirconium dioxide equivalent is from 0.5 to 17 percent by weight of the solution.

13. The composition of claim 12 wherein the zirconium compound is chloride based.

14. The composition of claim 5 further comprising a viscosity lowering agent selected from the group consisting of urea, carbonate and bicarbonate.

15. The composition of claim 14 wherein the viscosity lowering agent is ammonium carbonate.

16. The composition of claim 1 wherein the zirconium chelate is chosen from the group consisting of alkali metal, amine or amine derviative zirconium chelates.

* * * * *